US008101052B2

(12) United States Patent
Hsiao et al.

(10) Patent No.: US 8,101,052 B2
(45) **Date of Patent: *Jan. 24, 2012**

(54) ADJUSTABLE ANODE ASSEMBLY FOR A SUBSTRATE WET PROCESSING APPARATUS

(75) Inventors: Yi-Li Hsiao, Hsinchu (TW); Chen-Hua Yu, Hsin-Chu (TW); Jean Wang, Hsin Chu (TW); Lawrance Sheu, Hsinchu (TW)

(73) Assignee: Taiwan Semiconductor Manufacturing Co., Ltd., Hsin-Chu (TW)

( * ) Notice: Subject to any disclaimer, the term of this patent is extended or adjusted under 35 U.S.C. 154(b) by 1426 days.

This patent is subject to a terminal disclaimer.

(21) Appl. No.: 11/563,515

(22) Filed: Nov. 27, 2006

(65) Prior Publication Data

US 2008/0121526 A1 May 29, 2008

(51) Int. Cl.
*C25D 17/12* (2006.01)
*C25B 9/12* (2006.01)

(52) U.S. Cl. ..... 204/272; 204/242; 205/96

(58) Field of Classification Search ..... 204/242, 204/272; 205/80, 96

See application file for complete search history.

(56) References Cited

U.S. PATENT DOCUMENTS 5,304,250 A 4/1994 Sameshima et al.
6,432,730 B2 8/2002 Okumura et al.
6,863,794 B2 3/2005 Tsai et al.
6,913,703 B2 7/2005 Strang et al.
7,829,815 B2 * 11/2010 Chen et al. ..... 219/121.48
2004/0256222 A1 * 12/2004 Griego et al. ..... 204/280
2005/0040049 A1 * 2/2005 Volodarsky et al. ..... 205/652
2005/0145500 A1 * 7/2005 Toyoda et al. ..... 205/123
2006/0137989 A1 * 6/2006 Hong ..... 205/148

FOREIGN PATENT DOCUMENTS

JP 2005-187948 A 7/2005

OTHER PUBLICATIONS

Machine Translation of JP 2005-187948.*

China Patent Application No. 2007101088471 filed Dec. 4, 2008. CN Office Action dated Nov. 7, 2008 which cites Japanese Patent Publication No. 2005-187948 published Jul. 14, 2005. CN.

* cited by examiner

*Primary Examiner* — Harry D Wilkins, III
*Assistant Examiner* — Bryan D. Ripa
(74) *Attorney, Agent, or Firm* — Duane Morris LLP

(57) ABSTRACT

An adjustable anode assembly for a wet processing apparatus to allow selective tuning of the electrical field density distribution within a wet process chemical of the apparatus, which in turn allows the process specification or specifications to be selectively varied across the process surface of a wafer when processed by the apparatus. The adjustable anode assembly includes an anode which may be divided into several plates, at least one of which is capable of being moved from a first plane to at least a second plane.

18 Claims, 15 Drawing Sheets

ADJUSTABLE ANODE ASSEMBLY FOR A SUBSTRATE WET PROCESSING APPARATUS

FIELD OF THE INVENTION

The present invention relates to semiconductor fabrication. In particular, the present invention relates to an apparatus and method for providing an anode-to-wafer gap that varies in height or thickness across the surface of a wafer to be wet processed in a wet processing apparatus.

BACKGROUND OF THE INVENTION

Many wet processes are performed in semiconductor fabrication. These processes may include electrochemical plating (ECP), electrochemical mechanical polishing (ECMP), spin-coating, cleaning and etching, to name some examples. Hence, many apparatuses have been designed and are currently available for wet processing wafers and other substrates.

A typical wet processing apparatus may include a process cell for confining a process chemical and a carrier head that holds a wafer within the cell so that it may be treated by the chemical contained in or introduced into the cell. In wet processing apparatuses, (e.g., ECP and ECMP apparatuses), the cell includes an anode of a fixed shape. During processing, the anode is typically located a certain distance from the wafer such that a three-dimensional space is defined between the anode and wafer. The chemical (e.g., an electrolyte containing ions of metal to be deposited on the substrate) disposed in or subsequently introduced into the space between the anode and the wafer, is subjected to an electric field that is generated in the chemical by applying an electric potential between the anode and the wafer which operates as a cathode. In the case of and electrolyte chemical, the electric field generated in the electrolyte causes the metal ions in the electrolyte to be deposited on the wafer, thereby forming a metal layer thereon.

One drawback of these wet processing apparatuses is that the height of the three-dimensional space between the anode and the wafer is the same across the entire wafer, consequently, the electrical field density distribution within the chemical cannot be controlled or varied. As semiconductor wafers increase in size and minimum device feature size decreases, the inability to control the electrical field density distribution within the chemical in the space will lead to device characteristics across the wafer that are undesired or which can not be selectively varied.

Accordingly, improved wet processing apparatuses and methods are needed which enable the density distribution within the chemical in the three-dimensional space between the anode and the wafer to be controlled.

SUMMARY

Disclosed herein is an apparatus comprising: a wafer or substrate carrier; a cell for confining a chemical; and an anode having an adjustable shape disposed in the cell. A space is formed between a wafer or substrate held by the carrier and the anode. The space has a height which can be selectively varied across the wafer or substrate by adjusting the shape of the anode.

Also disclosed herein is a method of manufacturing an integrated circuit. The method comprises the steps of: placing a wafer or substrate into a cell of a wafer or substrate processing apparatus, the cell including an anode having an adjustable shape; setting a space between the wafer or substrate and the anode; adjusting the shape of the anode so that the space across the wafer or substrate is capable of being selectively varied in height; and operating the apparatus to process the wafer, thereby forming the integrated circuit.

Further disclosed herein is an anode for a wet processing apparatus. The anode comprises: a plurality of plates; and at least one of the plates being movable relative to another one of the plates to allow a shape of the anode to be adjusted. The anode, in use in the wet processing apparatus, forms a space with a wafer or substrate processed by the apparatus, the space having a height which is capable of being selectively varied across the wafer or substrate when the shape of the anode is adjusted.

DETAILED DESCRIPTION

Figure 1:
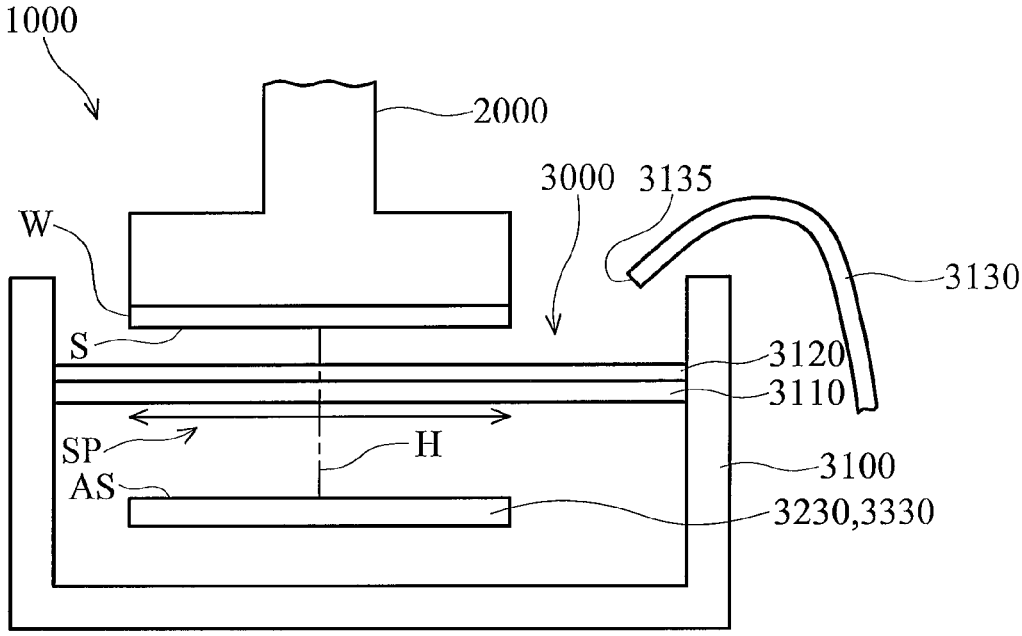
FIG. 1 is a schematic cross-sectional view of an embodiment of an electrochemical plating apparatus which uses an adjustable anode.

Disclosed herein is an adjustable anode assembly for an apparatus of the type which may be used in the wet processing of semiconductor wafers and other wafers and substrates. The adjustable anode assembly may be used in any wet processing or like apparatus that uses an anode including, for example but not limited to, electrochemical plating (ECP) apparatuses and an electrochemical mechanical polishing (ECMP) apparatuses. For ease in describing the adjustable anode, the same will be described with reference to an ECP apparatus, an embodiment of which is shown FIG. 1. The ECP apparatus, denote by numeral 1000 generally comprises a cell assembly 3000 and a carrier head assembly 2000 for holding a semiconductor wafer W or any other wafer or substrate to be wet processed in the cell assembly 3000 and for delivering DC power to the wafer W during plating and deplating.

The cell assembly 3000 forms a container or electroplating cell 3100 for confining an electrolyte plating solution comprising one or more metallic species including, in some embodiments, copper (Cu), aluminum (Al), tungsten (W), gold (Au), and silver (Ag), to name a few, which may be electrochemically deposited onto the wafer W.

The cell assembly 3000 includes an adjustable anode assembly 3230, 3330 disposed within the electroplating cell 3100. A diffuser 3110 and a porous pad 3120 may be disposed over the adjustable anode assembly 3230, 3330 within the cell 3100. In some embodiments, the diffuser 3110 supports the porous pad 3120 in the cell 3100 and provides a uniform distribution of the plating solution through the porous pad 3120 toward the wafer W. The porous pad 3120 may be conductive to ions in the plating electrolyte. In some embodiments, the metal plating electrolyte may be supplied to the porous pad 3120 through a fluid delivery conduit 3130, having an outlet 3135 positioned above the porous pad 3120. In other embodiments, the porous pad 3120 may be disposed adjacent to or in direct contact with the adjustable anode assembly 3230, 3330.

The carrier head assembly 2000 is movably positioned above the porous pad 3120. In one embodiment, the carrier head assembly 2000 includes a Z-motion mechanism that moves the carrier head assembly 2000, relative to the porous pad 3120, in a vertical direction. In other embodiments, the carrier head assembly 2000 may also include a tilt-motion mechanism that tilts the carrier head assembly 2000 relative to the porous pad 3120, and/or a rotation mechanism that rotates the carrier head assembly 2000 relative to the porous pad 3120. The Z-, tilt-, and rotation-motion mechanisms are well known in the art, therefore, the details of these mechanisms are not described herein. The carrier head assembly 2000 holds the wafer W with the surface S to be processed facing down toward the porous pad 3120. The carrier head assembly 2000 may be configured to hold semiconductor wafers of various sizes including, without limitation, 4, 5, 6, and 8 inch diameter semiconductor wafers and other wafers and substrates, and in preferred embodiments, semiconductor wafers and other wafers and substrates which are greater than 12 inches in diameter.

A metal layer may be deposited on the downward facing horizontal surface S (process surface) of the wafer W by contacting the process surface S with the porous pad 3120 and applying an electric potential between the adjustable anode assembly 3230, 3330 and the wafer W which operates as a cathode, to create an electrical field within the electrolyte plating solution disposed within a three-dimensional space SP formed between the top surface AS of the adjustable anode assembly 3230, 3330 and the process surface S of the wafer W. For additional details about the general construction and operation of ECPs, see for example, U.S. Pat. No. 6,863,794, which is incorporated herein by reference.

The shape of the adjustable anode assembly 3230, 3330 may be adjusted at any time (before or during processing) in accordance with a desired semiconductor process recipe to provide an electrical field density distribution within the electrolyte plating solution which suits a given process requirement, e.g., 45 nm and smaller process technology and/or 8-inch and larger wafers. The ability to provide a desired electrical field density distribution within the electrolyte plating solution allows for a wider process window and/or more process control.

More specifically, adjusting the shape of the anode 3230, 3330 from a planar shape to a non-planar shape, e.g., concave, convex, undulating, etc., allows selective tuning of the electrical field density distribution within the electrolyte plating solution, which in turn allows the process specification or specifications e.g., deposition rate, deposition profile, selectivity, and residue, to be selectively varied across the process surface S of the wafer W. This is because the non-planar shape of the adjustable anode assembly 3230, 3330 creates a three-dimensional space SP (between the top surface AS of the adjustable anode assembly 3230, 3330 and the process surface S of the wafer W) that has a height H that varies (in dimension) across the wafer W. The variable height H of the three-dimensional space SP, in turn, provides a correspondingly varied electrical field density distribution within the electrolyte plating solution which alters the process specification or specifications across the process surface S of the wafer W. Hence, the uniformity of the process specification or specifications may be controlled, as desired, across the process surface S of the wafer W.

Figure 2A:
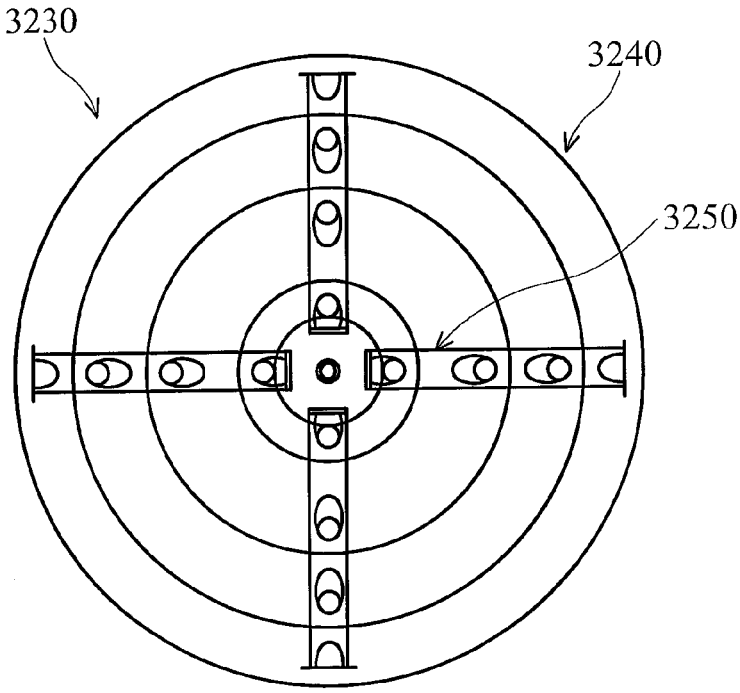
FIG. 2A is a bottom plan view of an embodiment of the adjustable anode assembly.
Figure 2B:
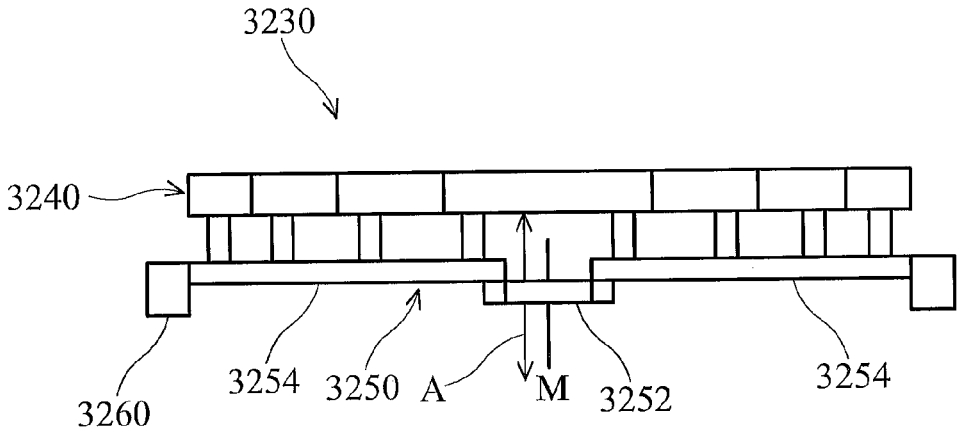
FIG. 2B is an elevational view of the adjustable anode assembly of FIG. 2A.

FIGS. 2A and 2B are bottom plan and elevational views of an embodiment of the adjustable anode assembly, denoted by numeral 3230. The adjustable anode assembly 3230 comprises a circular anode 3240 formed by a plurality of concentric plates and a linearly movable slide holder assembly 3250 for positioning the concentric anode plates into the same or various different planes, to create a variable thickness gap, which provides a desired electrical field density distribution within the chemical (e.g., electrolyte solution) that suits a given process requirement. In other embodiments, the adjustable anode may be square, rectangular, oval, etc., and/or divided into a plurality of adjustable plates which may or may not be concentric, but which move individually with respect to one another into different location settings.

Figure 3:
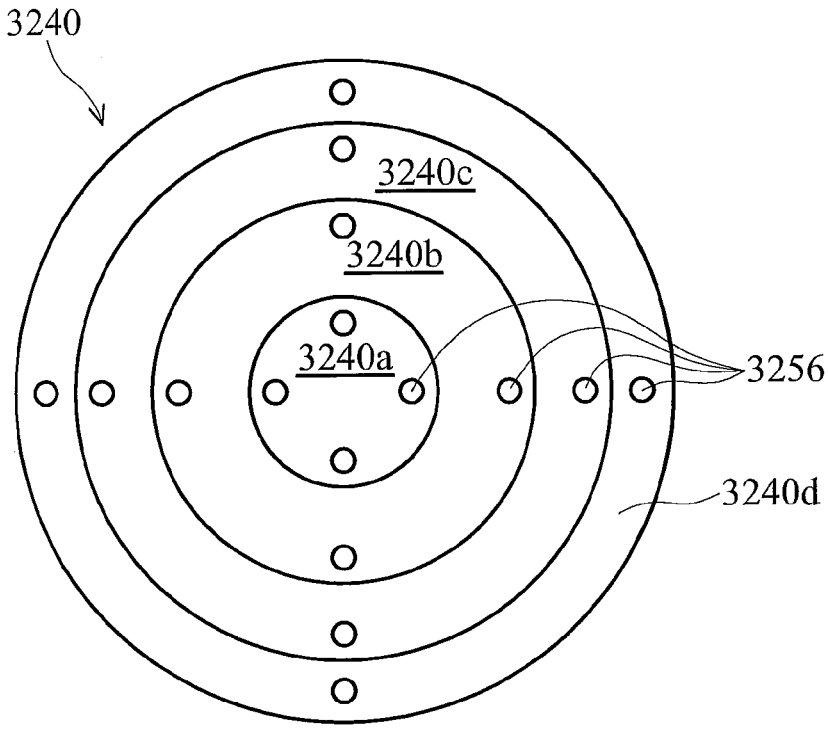
FIG. 3 is a bottom plan view of an anode of the adjustable anode assembly shown in FIGS. 2A and 2B.

As shown in the bottom plan view of FIG. 3, the plurality of concentric anode plates may be formed by a disc-shape central plate 3240*a*, two circular ring-shape intermediate plates 3240*b*, 3240*c* and a circular ring-shape outer plate 3240*d*. In other embodiments, the central plate, the ring-shape intermediate anode plates and/or the ring-shape outer plate may be other shapes including without limitation, square, rectangular, and oval. The plurality of concentric anode plates, in still other embodiments, may comprise any plural number of plates, depending upon the implementation. In some embodiments, the plates may be driven at different powers and/or frequencies by a corresponding plurality of DC power, pulse, RF or microwave generators.

Figure 4:
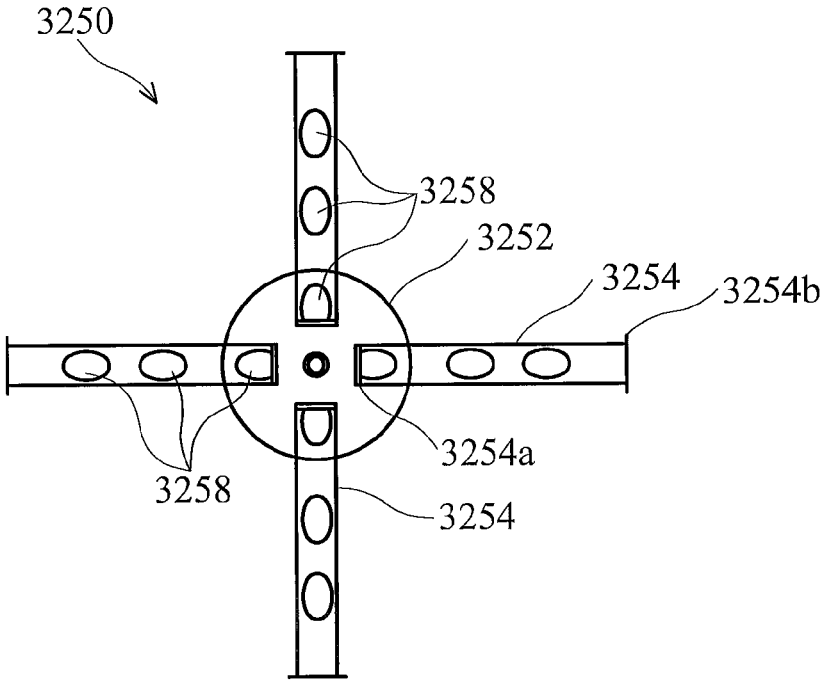
FIG. 4 is a plan view of a linearly movable slide holder assembly of the adjustable anode assembly shown in FIGS. 2A and 2B.

As shown in the plan view of FIG. 4, the linearly movable slide holder assembly 3250, may comprise an axially movable central hub member 3252, two or more arm members

3254 radially extending from the central hub member 3252, and a plurality of rod-shape connecting elements 3256 (see for example FIGS. 3, 5A and 5B) connecting the arm members 3254 to concentric anode plates 3240*a*, 3240*b*, 3240*c*, 3240*d*. The arm members 3254 have inner ends 3254*a* which are pivotally connected to the central hub member and outer ends 3254*b* that are configured to be pivotally connected to a fixed anode support structure 3260 (FIG. 2B) inside the cell assembly 3000.

Figure 5A:
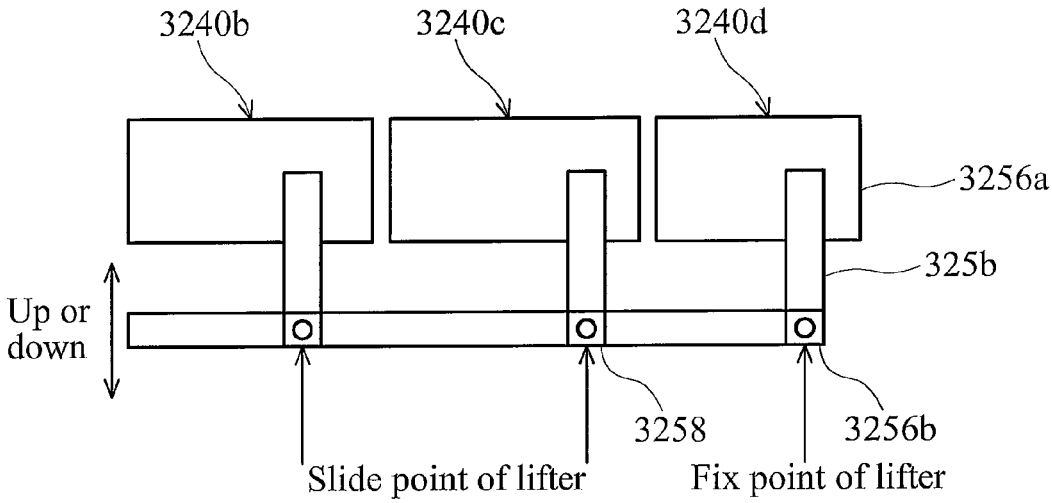
FIG. 5A is a partial elevational view of the adjustable anode assembly shown in FIGS. 2A and 2B.

As shown in the partial elevational view of FIG. 5A, lower portions of the connecting elements 3256 extend through elongated openings 3258 (FIG. 4) in the arm members 3254 and have upper ends 3256*a* which may be connected to the concentric anode plates 3240*a*, 3240*b*, 3240*c*, 3240*d* in a fixed manner and enlarged lower ends 3256*b* which prevent the connecting elements 3256 from being withdrawn through the elongated openings 3258 and disconnecting from the arm members 3254. The connecting elements 3256 slide outwardly or inwardly within the elongated openings 3258 of the arm members 3254 as the arm members 3254 pivot up or down, respectively, thereby allowing upper surfaces of the anode plates 3240*a*, 3240*b*, 3240*c*, 3240*d* to stay parallel with the process surface S of the wafer W as the shape of the anode 3240 is adjusted. In the embodiment shown in FIGS. 2A, 2B, 3, 4, 5A, and 6A-6C, each of the anode plates 3240*a*, 3240*b*, 3240*c*, 3240*d* is connected to one of the arm members 3254 by at least one connecting element 3256. In other embodiments, one or more of the anode plates may be fixed and thus, only the vertically moveable anode plates would be connected to the arm members by the connecting elements.

Referring again to FIG. 2B, the axially moveable central hub 3252, may be vertically moved (e.g., up and down) along its central axis A by an actuator M, such as a stepper motor controlled linear actuator. In other embodiments, other types of actuators may be used for axially moving the central hub up and down to change the shape of the anode 3240.

Figure 5B:
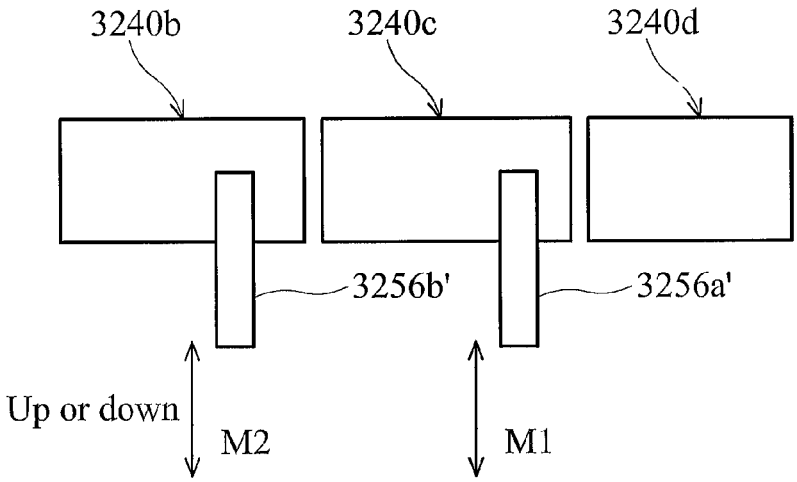
FIG. 5B is a partial elevational view showing another embodiment of the adjustable anode assembly shown in FIGS. 2A and 2B.
Figure 6A:
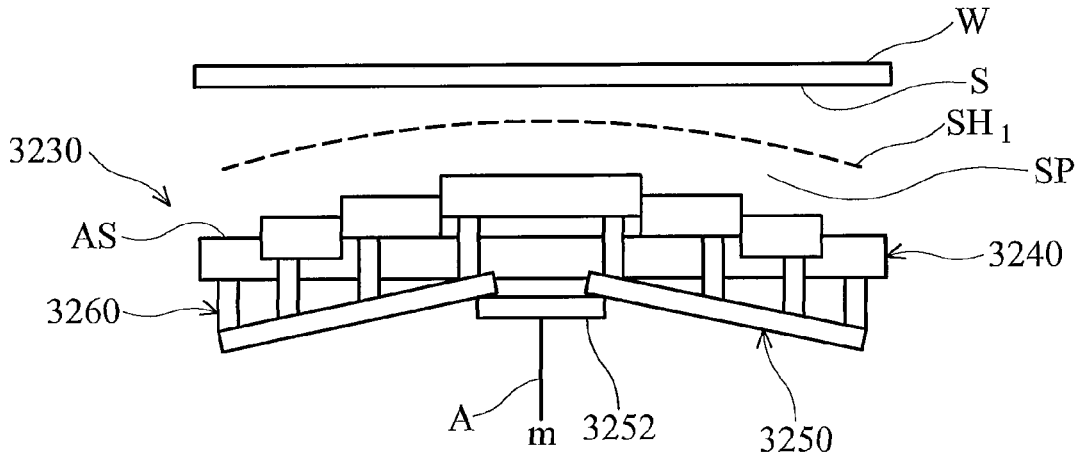
FIGS. 6A-6C are elevational views illustrating the operation of the adjustable anode assembly shown in FIGS. 2A and 2B.
Figure 6B:
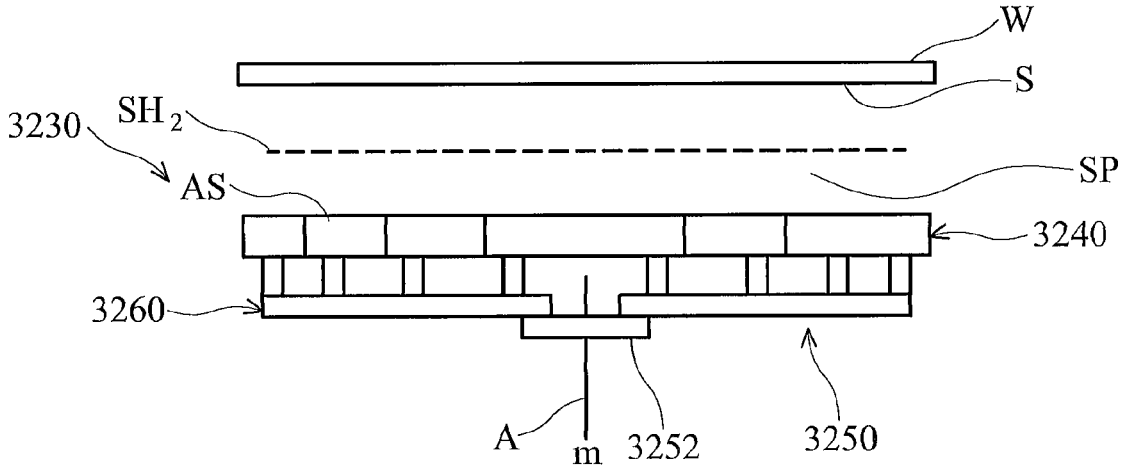
Figure 6C:
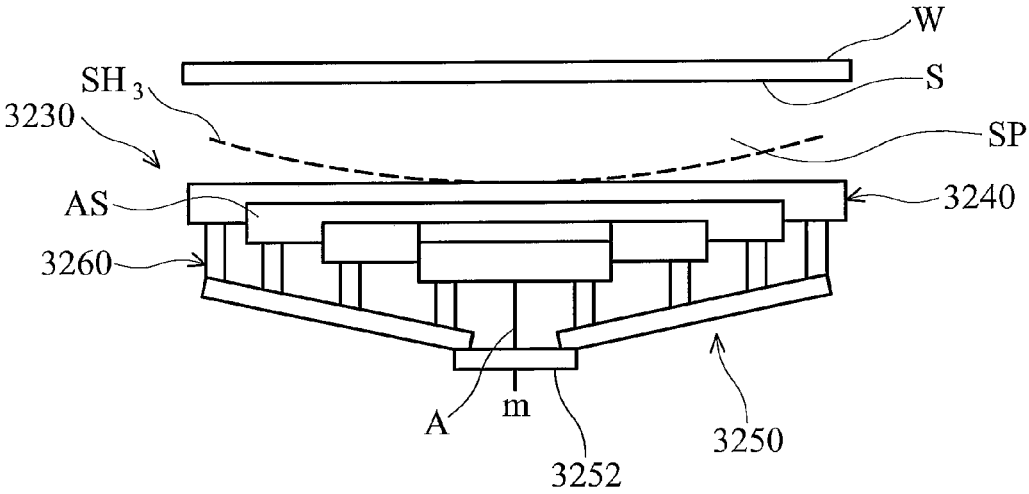
Figure 6D:
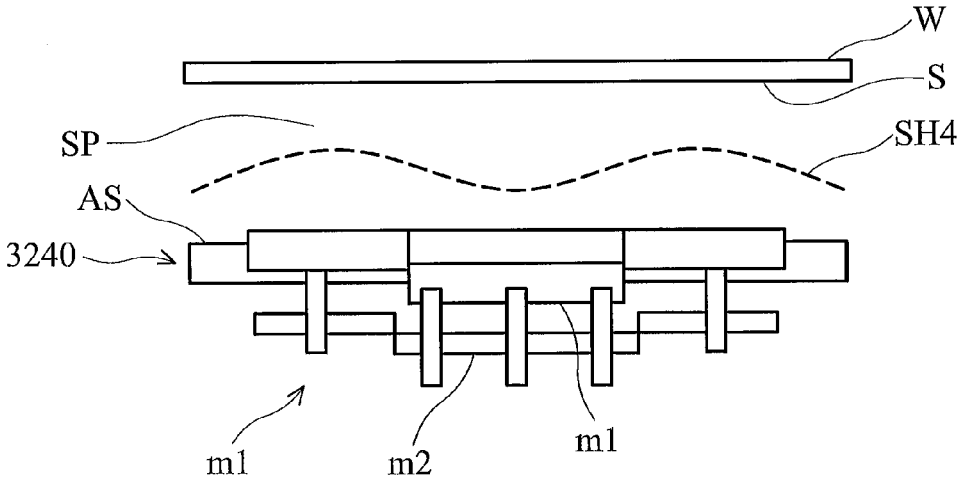
FIG. 6D is an elevational views illustrating the operation of the adjustable anode assembly shown in FIG. 5B.

FIGS. 5B and 6D are partial and full elevational views, respectively, of a variation of the adjustable anode assembly shown in FIGS. 2A and 2B. In this embodiment, the central hub and arm members of the slide holder assembly are replaced by a plurality of actuators M1, M2, which operate directly on the connecting elements 3256*a*' and 3256*b*' to vertically move anode plates 3240*b* and 3240*c* up and down into different planes. The outer anode plate 3240*d* is fixed in the embodiment, however, in other embodiments, the outer anode plate may be vertically moveable via an actuator.

Although not shown, in further embodiments, the intermediate portions of the arm members may be pivotally connected to a fixed anode support structure inside the cell assembly and the outer ends of the arm members are then free to move up and down when the central hub is vertically moved by the actuator. In still other embodiments, (not shown) the central hub may be connected to a fixed anode support structure inside the cell assembly and the outer ends of the arm members are actuated to move (e.g., up and down) to change the shape of the anode.

Figure 7A:
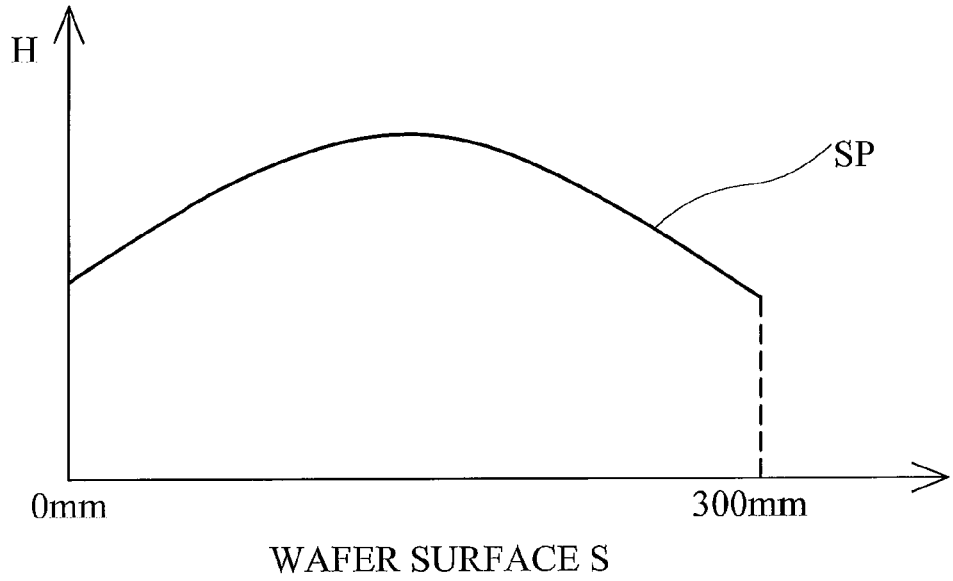
FIG. 7A illustrates the space between the anode and the wafer when the anode is adjusted as shown in FIG. 6A.
Figure 7B:
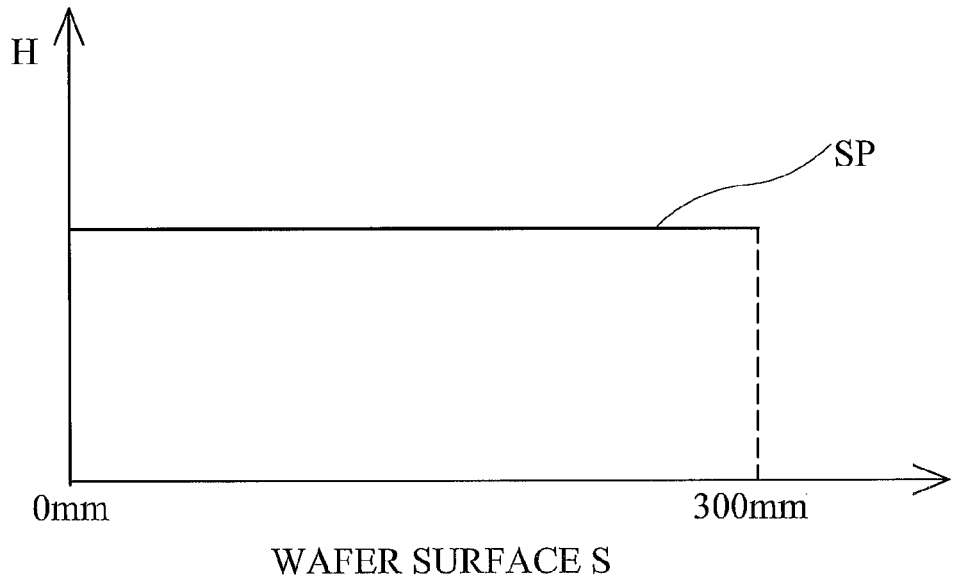
FIG. 7B illustrates the space between the anode and the wafer when the anode is adjusted as shown in FIG. 6B.
Figure 7C:
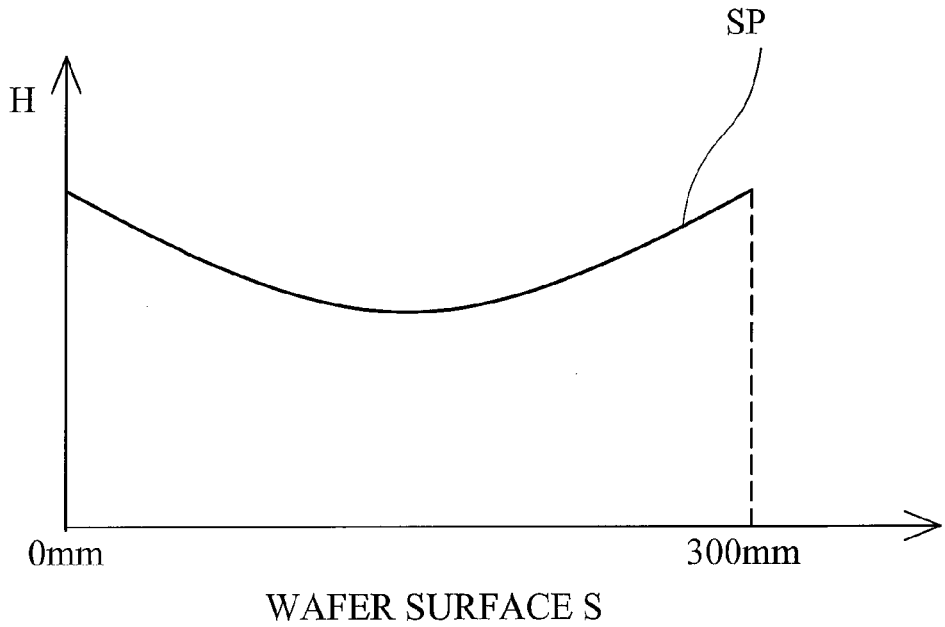
FIG. 7C illustrates the space between the anode and wafer when the anode is adjusted as shown in FIG. 6C.

Referring to the elevational views of FIGS. 6A-6C, the linearly movable slide holder assembly 3250 is operated to adjust the shape of the anode 3240, by operating the actuator M which moves the central hub 3252 up or down. The up or down movement of the central hub 3252 raises or lowers the anode plates 3240*a*, 3240*b*, 3240*c* into various different planes, thus varying the shape of the anode 3240. This in turn, as shown in FIGS. 7A-7C, varies the height H of the three-dimensional space SP across the surface S of the wafer W (e.g. a wafer having a 300 mm diameter), to provide a desired electrical field density distribution within the chemical which suits a given process requirement. FIG. 7A illustrates how the height H of the three-dimensional space SP varies in dimension across the surface S of the wafer W when the anode 3240, as shown in FIG. 6A, is adjusted into a shape $SH_1$ which is convex up. FIG. 7B illustrates how the height H of the three-dimensional space SP remains a constant dimension across the surface S of the wafer W when the anode 3240, as shown in FIG. 6B, is adjusted into a shape $SH_2$ which is generally planar. FIG. 7C illustrates how the height H of the three-dimensional space SP varies in dimension across the surface S of the wafer W when the anode 3240, as shown in FIG. 6C, is adjusted into a shape $SH_3$ which is concave down.

Figure 7D:
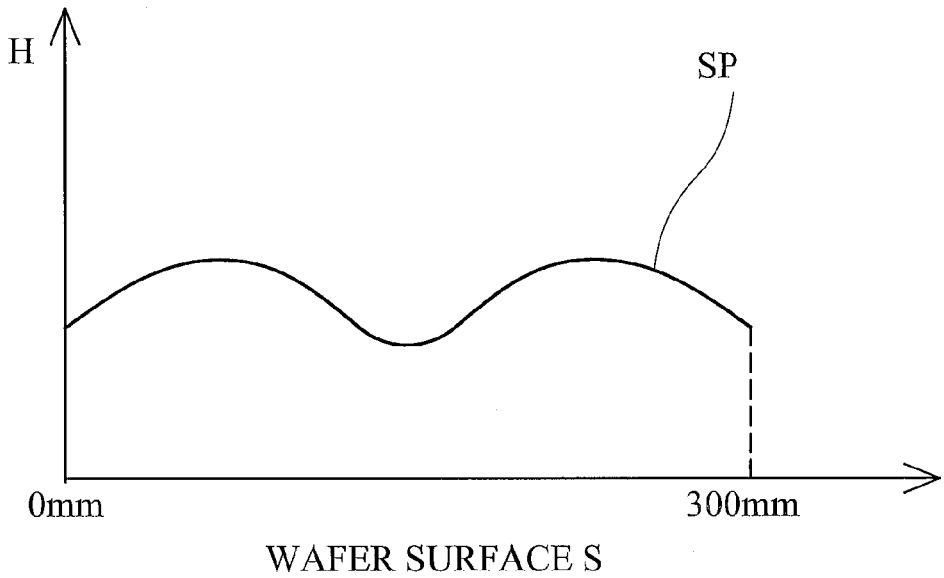
FIG. 7D illustrates the space between the anode and wafer when the anode is adjusted as shown in FIG. 6D.

One or both of the actuators M1, M2 of the adjustable anode assembly shown in FIGS. 5B and 6D, are operated to raise or lower the anode plates 3240*b*, 3240*c* into various different planes, thus varying the shape of the anode 3240. As in the previous embodiment, varying the shape of the anode 3240 varies the height H of the three-dimensional space SP across the surface S of the wafer W. FIG. 7D illustrates how the height H of the three dimensional space SP varies in dimension across the surface S of the wafer W when the anode 3240, as shown in FIG. 6D, is adjusted into a shape $SH_4$ which is undulating.

Figure 8A:
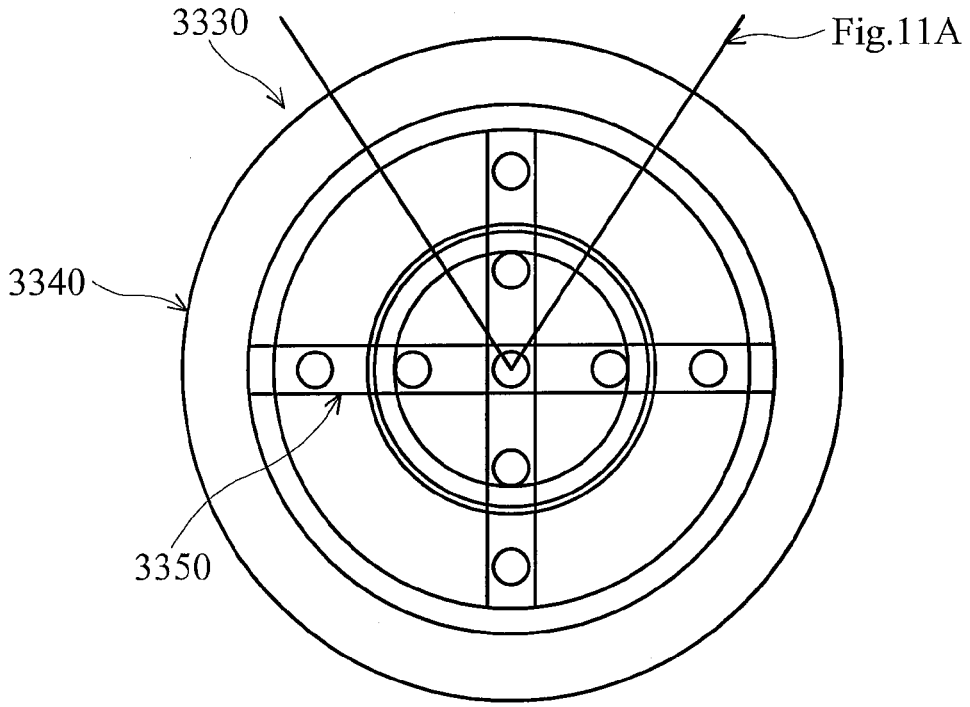
FIG. 8A is a bottom plan view of another embodiment of the adjustable anode assembly.
Figure 8B:
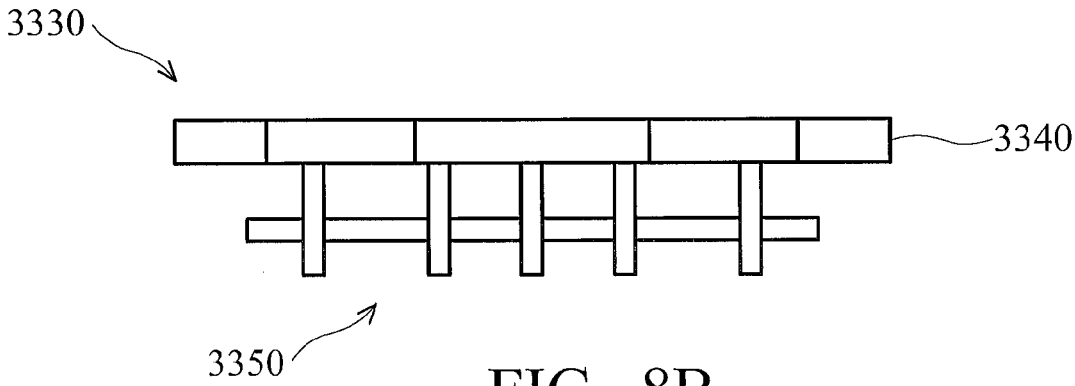
FIG. 8B is an elevational view of the adjustable anode assembly of FIG. 8A.

The bottom plan view of FIG. 8A and the elevational view of FIG. 8B collectively show another embodiment of the tunable anode, denoted by numeral 3330. The tunable anode 3330 comprises an anode 3340 formed by a plurality of concentric plates similar to the previous embodiments, and a rotatable slide holder assembly 3350 for varying the shape of the anode.

Figure 9:
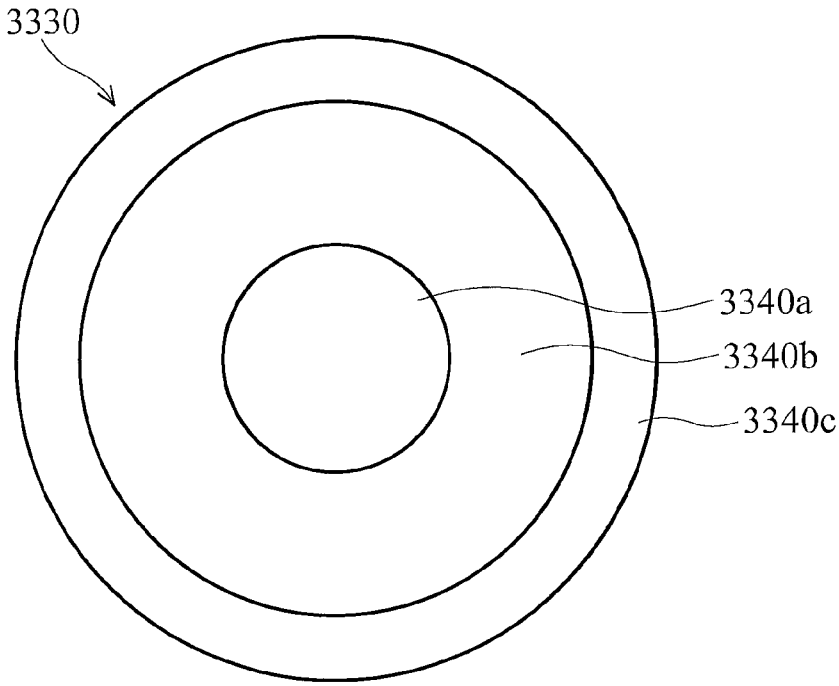
FIG. 9 is a bottom plan view of an anode of the adjustable anode assembly shown in FIGS. 8A and 8B.

As shown in the bottom plan view of FIG. 9, the plurality of concentric plates may comprise a disc-shape central plate 3340*a*, a circular ring-shape intermediate plate 3340*b* and a circular ring-shape outer plate 3340*c*. In some embodiments, the plates may be driven at different powers and/or frequencies by a corresponding plurality of DC power, pulse, RF, or microwave generators.

Figure 10:
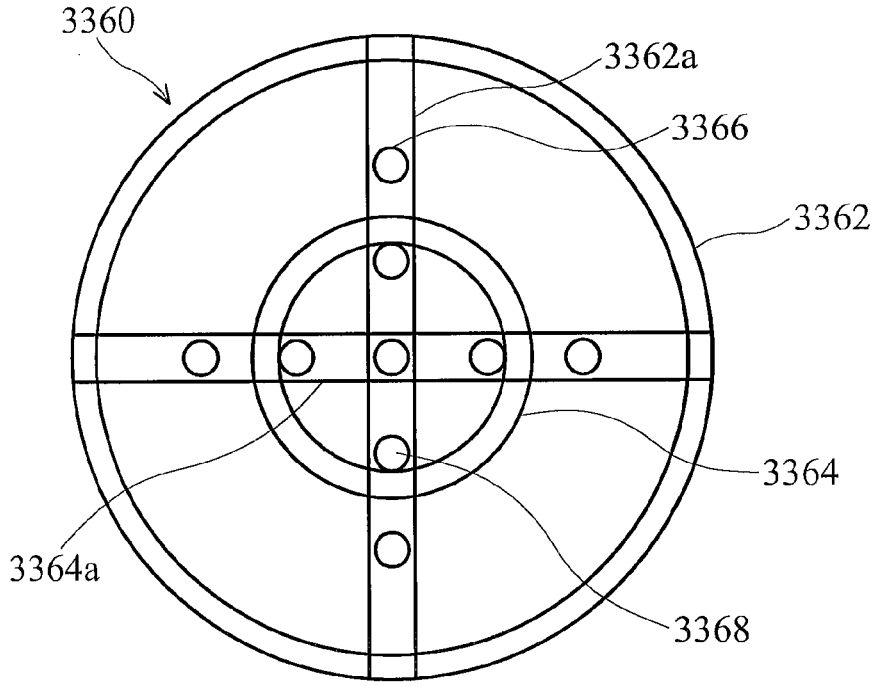
FIG. 10 is a plan view of a rotatable slide holder assembly of the adjustable anode assembly shown in FIGS. 8A and 8B.
Figure 11A:
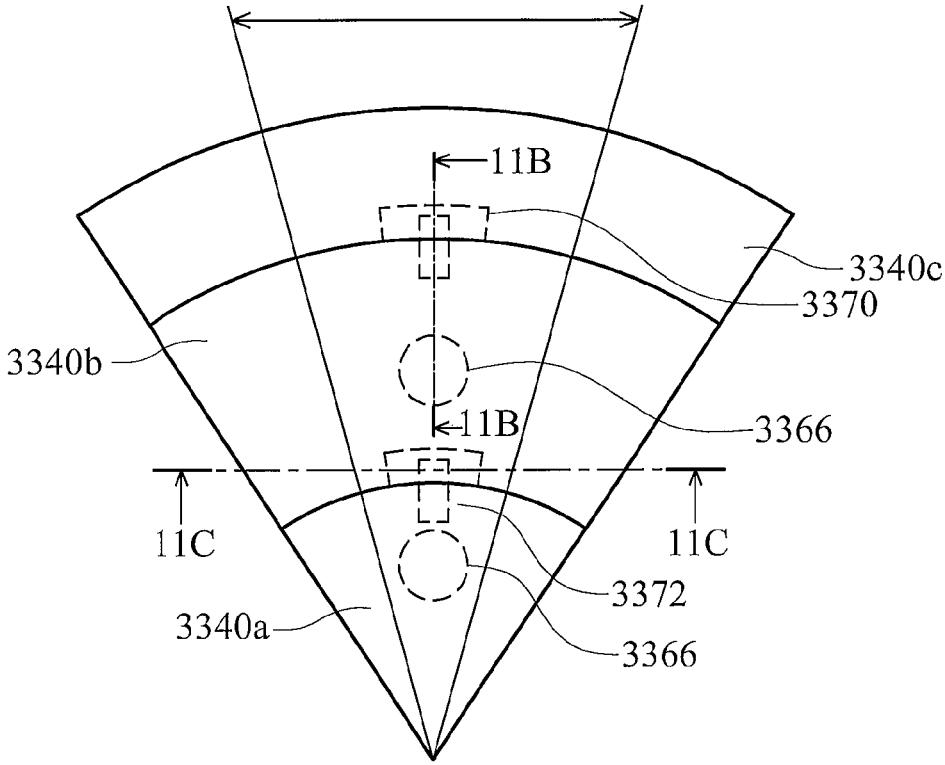
FIG. 11A is a sectional view of the V-shape area shown in FIG. 8A.
Figure 11B:
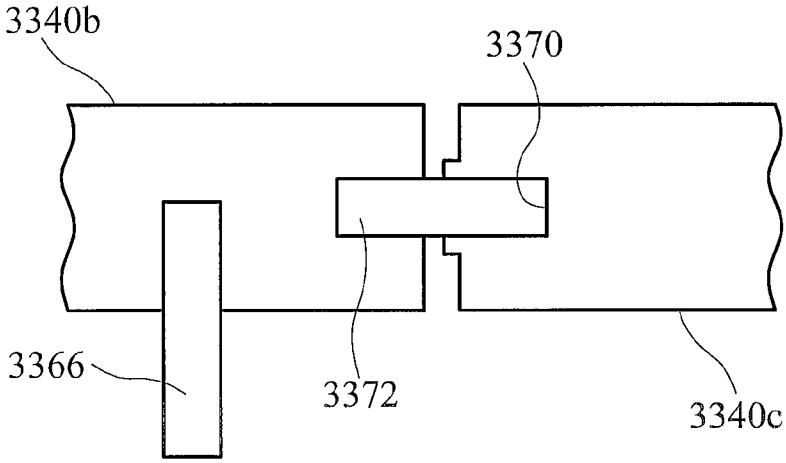
FIG. 11B is a sectional view through line 11B-11B of FIG. 11A.
Figure 11C:
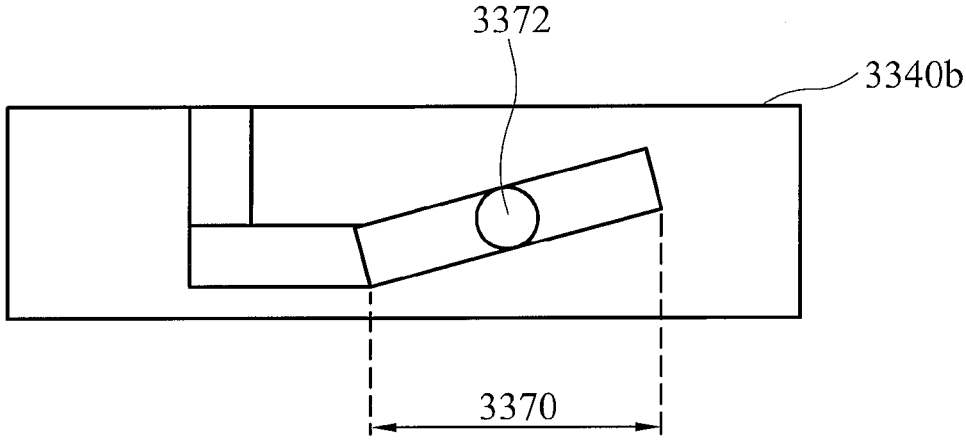
FIG. 11C is a sectional view through line 11C-11C of FIG. 11A.
Figure 11D:
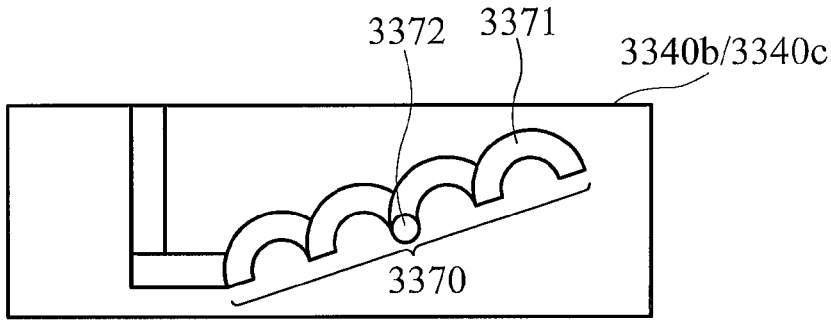
FIG. 11D is a sectional view similar to the view shown in FIG. 11C showing an alternative embodiment of a cam groove.

The rotatable slide holder assembly 3350 may comprise a plate rotating apparatus 3360, as shown in plan view FIG. 10, for selectively rotating one or more of the anode plates 3340*a*, 3340*b*, 3340*c*, and a cam groove and follower arrangement collectively shown in FIGS. 11A-11D, for causing the anode plates 3340*a*, 3340*b*, 3340*c* to move vertically up or down when rotated relative to one another by the rotating apparatus 3360, thereby positioning them in the same or different planes to change the shape of the anode 3340.

Referring to FIG. 10, the rotating apparatus 3360 may comprise an outer rim member 3362 for rotating the intermediate plate 3340*b* and an inner rim member 3364 for rotating the central plate 3340*a*. The outer rim member 3362 may have at least one flange 3362*a* for slidably receiving an end of a rod-shape connecting element 3366, which is fixedly connected to the intermediate anode plate 3340*b*. The inner rim member 3364 may have at least one cross arm 3364*a* for slidably receiving an end of another rod-shape connecting element 3368 fixedly connected to the central anode plate 3340*a*. The outer and inner rim members 3362 and 3364 may be selectively rotated by corresponding actuators (not shown), such as stepper motors. In other embodiments, other suitable types of actuators may be used for rotating the outer and inner rim members 3362 and 3364.

The cam groove and follower arrangement connects the anode plates 3340*a*, 3340*b*, 3340*c* to one another so that relative rotation between adjacent anode plates causes one of the plates to move vertically up or down relative to the other plate depending upon the direction of rotation, thereby enabling the adjacent plates to be positioned in the same or different planes.

Referring now to FIGS. 11A-11D, the cam groove and follower arrangement may comprise two or more equi-spaced inclined, linear cam grooves 3370 formed in the inner peripheral surface of each of the outer and intermediate anode plates 3340*c* and 3340*b* and corresponding equi-spaced cam groove followers 3372 projecting from the outer peripheral surface of each of the central and intermediate anode plates 3340*a* and 3340*b*. Alternatively, the cam followers 3372 may be provided on the inner peripheral surfaces of the outer and intermediate anode plates 3340*c* and 3340*b* and the corresponding inclined cam grooves 3370 may be formed in the outer peripheral surfaces of the central and intermediate anode plates 3340*a* and 3340*b*.

Figure 12A:
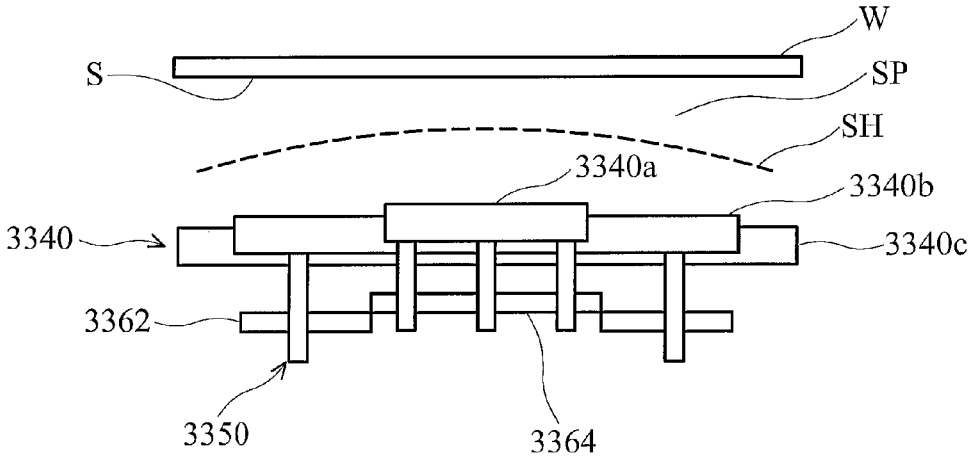
FIGS. 12A-12D are elevational views illustrating the operation of the adjustable anode assembly shown in FIGS. 8A and 8B.
Figure 12B:
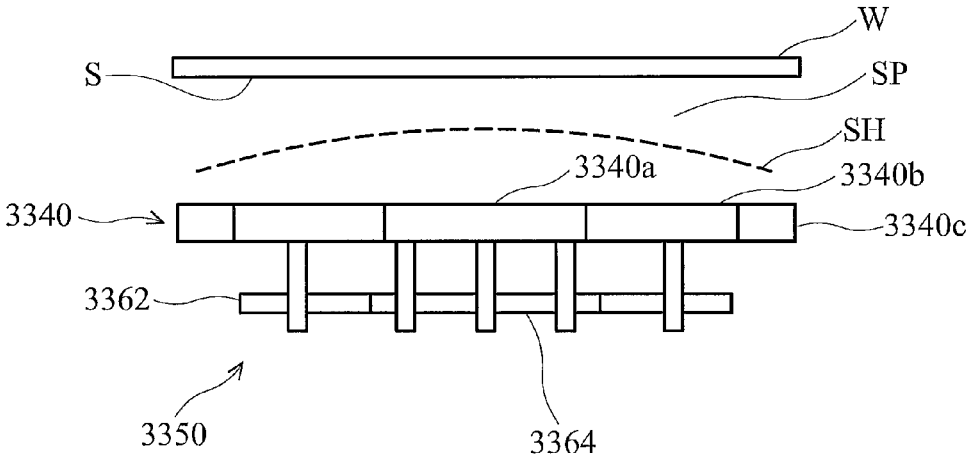
Figure 12C:
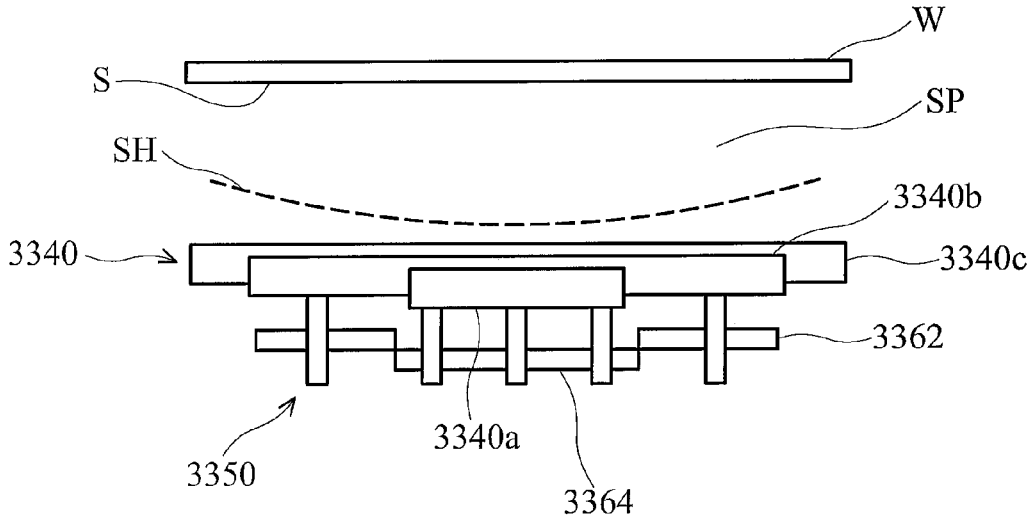
Figure 12D:
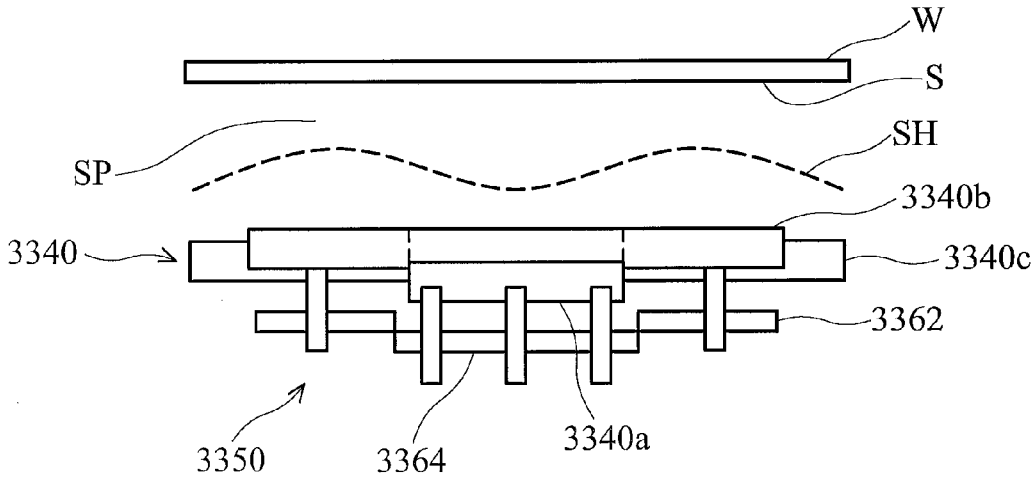

FIG. 12D shows another embodiment wherein each of the cam grooves denoted by numeral 3370' may be configured with a plurality of arcuate-shape detents 3371 to provide a plurality of discrete anode shape adjustments.

The rotatable slide holder assembly 3350 is operated to adjust the shape of the anode 3340, by operating the actuator (s) which rotate the outer and/or inner rim members 3362, 3364. As shown in FIGS. 12A-12D, the outer rim member 3362 rotates the intermediate anode plate 3340*b* relative to the fixed outer anode plate 3340*c* thereby causing the intermediate anode plate 3340*b* to move vertically up or down relative to the outer anode plate 3340*c*. The inner rim member 3364 rotates the central anode plate 3340*a* relative to the intermediate anode plate 3340*b* thereby causing the central anode plate 3340*a* to move vertically up or down relative to the intermediate anode plate 3340*b*. As the central and intermediate anode plates 3340*a* and 3340*b* rotate, the cam followers slide (FIG. 11C) or move step-wise (FIG. 11D) up or down their associated cam grooves, depending upon the direction of rotation, thereby causing the central and intermediate anode plates 3340*a* and 3340*b* to move vertically up or down, depending upon the direction of rotation, thus varying the shape of the anode 3340. This, in turn, varies the height H of the three-dimensional space SP across the surface S of the wafer W, to provide a desired electrical field density distribution within the chemical which suits a given process requirement.

The anode of the adjustable anode assembly may be made of any suitable electrode material. In some embodiments, the anode may be made of a Shape Memory Alloy (SMA) or any other materials with malleability and ductility. The slide holder assemblies of the adjustable anode assembly may be made of any suitable material including, but not limited to, metal materials, ceramic materials, or the same material the corresponding anode is made of.

Figure 13:
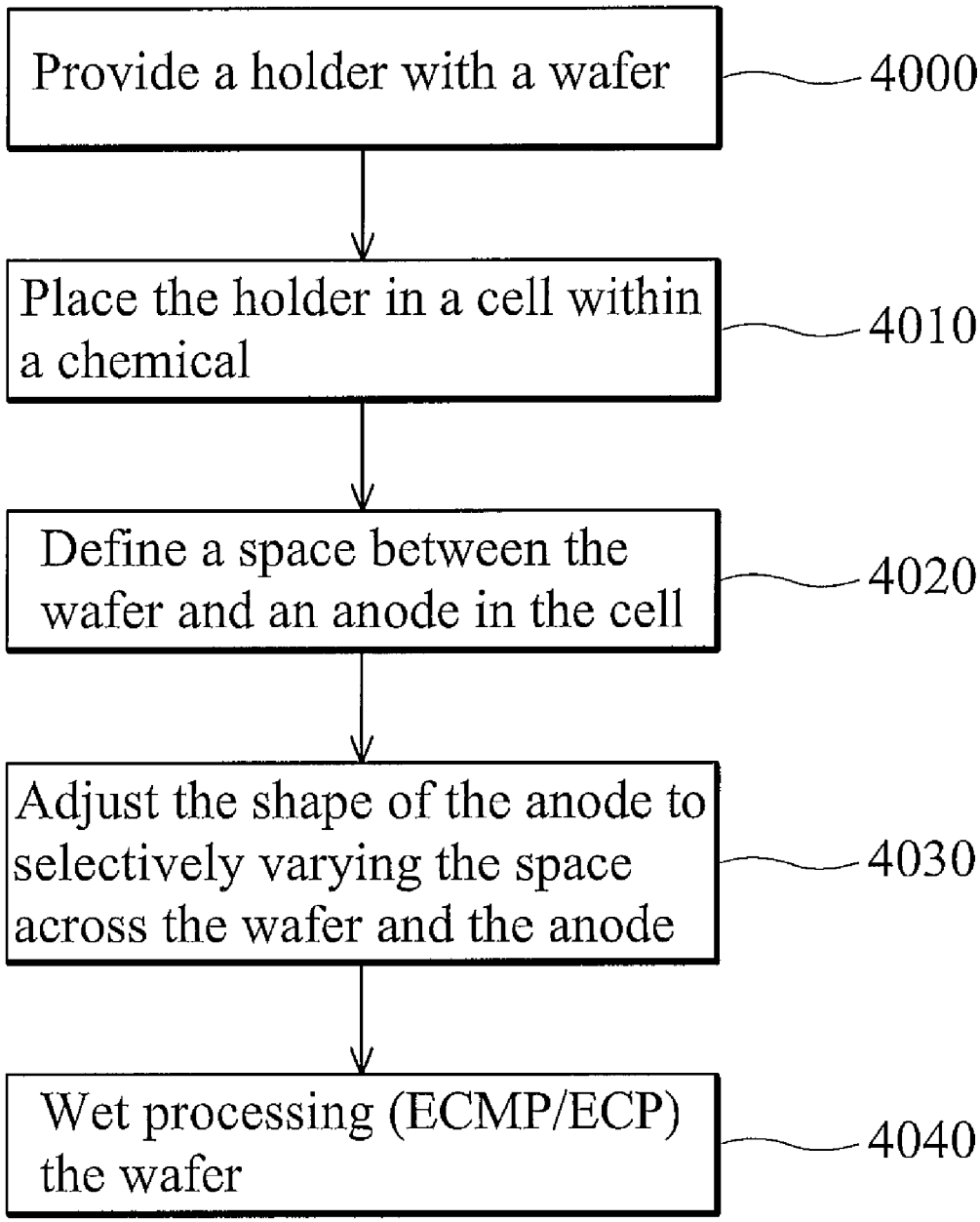
FIG. 13 is a flowchart illustrating the steps of an embodiment of a wafer wet processing method using the adjustable anode assembly in a wet processing apparatus.

FIG. 13 is a flowchart illustrating the steps of an embodiment of a wafer wet processing method using the adjustable anode assembly in a wet processing apparatus. The method may be used for manufacturing an integrated circuit. The wet processing apparatus may be an ECP apparatus, such as described above with reference to FIG. 1. In other embodiments, the wet processing apparatus may be an ECMP apparatus or other wafer or substrate processing apparatus.

The method commences in step 4000, by placing a wafer into a holder of the carrier head assembly of the wet processing apparatus.

In step 4010, the holder with the wafer is placed in the processing cell of the wet processing apparatus. The processing cell contains a chemical for processing the wafer. The holder is place in the processing cell so that the wafer is immersed in the chemical contained therein.

In step 4020, a space is set or defined between the wafer and the anode of the adjustable anode assembly.

In step 4030, the shape of the adjustable anode assembly is adjusted to selectively vary the space across the wafer and the anode of the adjustable anode assembly.

In step 4040, the wet process apparatus is operated to wet process the wafer.

Although the invention has been described in terms of exemplary embodiments, it is not limited thereto. Rather, the appended claims should be construed broadly, to include other variants and embodiments of the invention, which may be made by those skilled in the art without departing from the scope and range of equivalents of the invention.

What is claimed is:

1. A wet processing apparatus comprising:

a movable carrier head assembly for holding a wafer or substrate;

a cell for confining a chemical;

an anode having an adjustable shape disposed in the cell, the anode formed by at least two plates which are movable relative to one another for changing the shape of the anode; and an assembly for moving one of the at least two plates relative to the other one of the at least two plates, the assembly including a movable hub member and two or more arm members extending from the hub member, the two or more arm members connected to the at least two plates;

wherein a space is formed between a wafer or substrate held by the carrier head assembly and the anode, the space having a height which can be selectively varied across the wafer or substrate by adjusting the shape of the anode.

2. The apparatus of claim 1, wherein the plates are concentric.

3. The apparatus of claim 1, wherein the each of the at least two plates is driven individually by a corresponding electrical frequency generator.

4. The apparatus of claim 1, wherein the apparatus comprises an electrochemical plating apparatus.

5. The apparatus of claim 1, wherein the apparatus comprises an electrochemical mechanical polishing apparatus.

6. The apparatus of claim 1, wherein the carrier head assembly is configured to hold a semiconductor wafer or substrate having a diameter of about 4 inches or larger.

7. The apparatus of claim 1, wherein the carrier head assembly includes a mechanism for moving the carrier head assembly in a vertical direction.

8. The apparatus of claim 1, wherein the carrier head assembly includes a mechanism for tilting the carrier head assembly.

9. The apparatus of claim 1, wherein the carrier head assembly includes a mechanism for rotating the carrier head assembly.

10. A wet processing apparatus comprising:

a movable carrier head assembly for holding a wafer or substrate;

a cell for confining a chemical;

an adjustable anode; and a linearly movable assembly for adjusting the adjustable anode, the linearly movable assembly including an arm member and a plurality of rod-shape connecting elements connecting the arm member to the adjustable anode;

wherein a space is formed between a wafer or substrate held by the carrier head assembly and the anode, the space having a height which can be selectively varied across the wafer or substrate by adjusting the shape of the anode.

11. The apparatus of claim 10, wherein the plates are concentric.

12. The apparatus of claim 10, wherein the each of the at least two plates is driven individually by a corresponding electrical frequency generator.

13. The apparatus of claim 10, wherein the apparatus comprises an electrochemical plating apparatus.

14. The apparatus of claim 10, wherein the apparatus comprises an electrochemical mechanical polishing apparatus.

15. The apparatus of claim 10, wherein the carrier head assembly is configured to hold a semiconductor wafer or substrate having a diameter of about 4 inches or larger.

16. The apparatus of claim 10, wherein the carrier head assembly includes a mechanism for moving the carrier head assembly in a vertical direction.

17. The apparatus of claim 10, wherein the carrier head assembly includes a mechanism for tilting the carrier head assembly.

18. The apparatus of claim 10, wherein the carrier head assembly includes a mechanism for rotating the carrier head assembly.

* * * * *